US006368486B1

(12) United States Patent
Thompson et al.

(10) Patent No.: US 6,368,486 B1
(45) Date of Patent: Apr. 9, 2002

(54) LOW TEMPERATURE ALKALI METAL ELECTROLYSIS

(75) Inventors: Jeffrey S. Thompson; Howard M. Blank, both of Wilmington, DE (US); Walter John Simmons, Martinsburg, WV (US); Oswald Robert Bergmann, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/536,424

(22) Filed: Mar. 28, 2000

(51) Int. Cl.[7] ..... C25C 3/02
(52) U.S. Cl. ..... 205/406; 205/407; 205/409; 205/367; 205/560
(58) Field of Search ..... 205/560, 367, 205/406, 407, 408, 409

(56) References Cited

U.S. PATENT DOCUMENTS

| | | | | | |
|---|---|---|---|---|---|
| 3,472,745 | A | * | 10/1969 | Heredy | 205/407 |
| 4,156,635 | A | * | 5/1979 | Cooper et al. | 205/407 |
| 4,389,287 | A | * | 6/1983 | Skala | 205/346 |
| 4,463,071 | A | * | 7/1984 | Gifford et al. | 429/213 |
| 4,853,094 | A | * | 8/1989 | Honders et al. | 205/363 |
| 5,064,513 | A | * | 11/1991 | Boutin et al. | 205/367 |

FOREIGN PATENT DOCUMENTS

JP 04088188 A * 3/1992

OTHER PUBLICATIONS

Plating and stripping of sodium from a room temperature 1,2–dimethyl–3–propylimidazolium chloride melt, J. Electrochem. Soc. vol. 143, No. 7, pp. 2262–2266, Jul. 1996.

Room–te,perature Ionic liquids. Solvents for synthesis and catalysis, Thomas Welton, *Chemical Reviews*, 99, 2071–2084 (1999).

* cited by examiner

*Primary Examiner*—Donald R. Valentine
*Assistant Examiner*—Wesley A. Nicolas

(57) ABSTRACT

A low temperature alkali metal electrolysis process for carrying out the electrolysis in the presence of a co-electrolyte and an alkali metal halide. The co-electrolyte comprises (1) a nitrogen-containing compound and optionally one ore more Group IB halides, Group IIIA halides, Group VIII halides; (2) a Group IIIA halide, a Group VB halide, or combinations of a Group IIIA halide and a Group VB halide; or (3) water. Further provided is an electrolyte comprising an alkali metal halide and a co-electrolyte that comprises (1) a nitrogen-containing compound and optionally one ore more Group IB halides, Group IIIA halides, Group VIII halides or (2) a Group IIIA halide, a Group VB halide, or combinations of a Group IIIA halide and a Group VB halide.

18 Claims, No Drawings

LOW TEMPERATURE ALKALI METAL ELECTROLYSIS

FIELD OF THE INVENTION

The invention relates to an electrolysis process and electrolytes therefor for producing an alkali metal.

BACKGROUND OF THE INVENTION

Alkali metals are highly reactive elements and are not found in elemental form in nature. Typical reducing agents, such as hydrogen, are not strong enough to reduce the alkali metals from their compounds to the metallic state. Electrolytic reduction is necessary and was used historically in the classic experiments leading to the discovery of the alkali metals in elemental form in 1807 by Sir Humphry Davy, Assistant to Count Rumford/Thompson at the Royal Institution in London. Electrolytic reduction is used for industrial production of the alkali metals. The currently used process, on a worldwide basis, is the so-called "Downs" Process, which was introduced in the early part of the 20th century for the production of sodium and lithium from their chlorides.

The Downs Process uses a molten salt electrolyte consisting of a mixture of NaCl, $CaCl_2$ and $BaCl_2$ in order to reduce the melting temperature of the electrolyte to slightly below 600° C. This makes the process more practical compared to using pure NaCl which has a much higher melting point of about 800° C. Nevertheless, operating an electrolytic process at such temperature is difficult and presents numerous operating constraints. Because of the high operating temperature of the Down Process, the cell design uses concentrically cylindrical cathodes, wire mesh diaphragms, and anodes rather than the much more space efficient stacked multiple flat electrode and diaphragm element configuration that is normally used in electrochemical engineering practice. Furthermore, the high operating temperature would make a flat wire-mesh steel diaphragm so soft that it would be mechanically unstable and flap back and forth between anode and cathode causing partial shorting/arcing and thereby causing holes to be burned in the diaphragm. Holes in the diaphragm would allow back mixing of sodium produced at the cathode and chlorine produced at the anode, thereby causing low current efficiency of the cell. On the other hand, the concentric cylindrical configuration of the steel diaphragm between the electrodes avoids this difficulty because a wire-mesh cylinder is mechanically much stiffer and mechanically more stable than a flat wire-mesh screen of the same kind.

The above-described concentric cylindrical cell design of the Downs Process, necessitated by the high operating temperature of about 600° C., also means that the Downs cell has very poor space efficiency. This translates directly into high capital and operating cost per unit production.

The high operating temperature of the Downs cell in combination with the fact that the molten mixed salt electrolyte has a freezing temperature only about 20° C. below the cell operating temperature makes smooth operation of the cells difficult. Cell 'freeze-ups' and other "upsets" are frequent and result in unusually high operating labor requirements for an industrial electrolytic process. This in turn is also the reason why the Downs Process is not amenable to automation. Lithium is currently produced by a modification of the Downs process.

Although there is a low temperature electrolytic process that deposits metallic sodium at the cathode from an NaCl/$H_2O$ solution, the sodium metal is not pure sodium but a liquid mercury/sodium amalgam containing a low percentage of sodium, usually about 0.5% Na. The balance of over 99% is mercury metal. This process is used to produce aqueous sodium hydroxide solutions by reacting the dilute sodium amalgam with water. See generally *Sodium, Its Manufacture Properties and Uses*, by Marshall Sitting, American Chemical Society Monograph Series, Reinhold Publishing Corp., New York (1956) and *Electrochemical Engineering*, by C. L. Mantell, McGraw-Hill Book Co., Inc., New York, Toronto, London (1960). This process cannot be used to produce metallic sodium economically because of the problems and the cost of separating mercury from sodium. For example, separation by distillation is impractical because mercury has a much lower boiling point (357° C.) than sodium (880° C.) and it would be too costly to vaporize 99% mercury to obtain about 1% sodium as the residue.

In recent years fundamental physico-chemical studies have been carried out on electrolytes based on non-aqueous, organic solvents for alkali metal chlorides for battery applications. See J. Electrochem. Soc. Vol. 143, No. 7, pages 2262–2266, July 1996. None of this work resulted in a process for alkali metal production.

Therefore, there is an increasing need to develop an electrolytic process that can be used to produce an alkali metal more economically. There is also a need to develop a process that can improve operability such as, for example, making automation possible.

SUMMARY OF THE INVENTION

According to the invention a low temperature electrolysis process is provided, which comprises carrying out the electrolysis in the presence of a co-electrolyte and an alkali metal halide. The co-electrolyte comprises (1) a nitrogen-containing compound and optionally a Group IIIA halide, a Group IB halide, a Group VIII halide, or combinations of two or more thereof; (2) a Group IIIA halide, a Group VB halide, or combinations of a Group IIIA halide and a Group VB halide; or (3) water.

Also according to the invention an electrolysis process is provided, which comprises carrying out the process using a cathode comprising (1) a liquid alkali metal; (2) a liquid low melting alloy of two or more metals selected from the group consisting of bismuth, lead, tin, antimony, indium, gallium, thallium, and cadmium; or (3) a conductive liquid solvated alkali metal.

Further according to the invention an electrolyte is provided. The electrolyte comprises an alkali metal halide and a co-electrolyte that comprises (1) a nitrogen-containing compound and optionally a Group IIIA halide, a Group IB halide, a Group VIII halide, or combinations of two or more thereof; (2) a Group IIIA halide, a Group VB halide, or combinations of a Group IIIA halide and a Group VB halide; or (3) water.

DETAILED DESCRIPTION OF THE INVENTION

The electrolysis is carried out at a low temperature. The term "low temperature" refers to a temperature lower than about 300° C., preferably lower than about 250° C., and most preferably lower than 200° C. It can be in the range of from about 20° C. to about 300° C., preferably about 50° C. to 250° C., more preferably about 70° C. to about 200° C., and most preferably 90° C. to 200 ° C. The invention electrolysis can produce a substantially pure alkali metal such as sodium. The term "substantially pure" refers to an alkali metal containing less than about 400, preferably less than about 300, more preferably less than about 200 and most preferably less than 100 mg of impurities per kg of the alkali metal.

Any alkali metal halides can be used in the invention. The term "alkali metal" is referred to lithium, sodium, potassium, rubidium, cesium, francium, or combinations of two or more thereof. The presently preferred alkali metal halide is sodium chloride for it is widely used in an electrolysis to produce sodium.

According to one embodiment of the invention, a nitrogen-containing compound, preferably a nitrogen-containing ionic compound having a cationic moiety and an anionic moiety, can be used as a co-electrolyte. It can be a solid or liquid. Presently, a non-aqueous liquid is preferred. Preferably, the cationic moiety is an organic cation. The cationic moiety includes one or more imidazolium salts, N-alkylpyridinium salts, tetraalkylammonium salts, and tetraalkylphosphonium salts. For example, any imidazolium salts that, when combined with an alkali metal halide, can reduce the melting point of an alkali metal halide to a low temperature disclosed above can be used.

The anion moiety can be any anion as long as it can be used to lower the melting point of an alkali metal halide. Examples of suitable anions include one or more chloride, bromide, iodide, tetrafluoroborate, and hexafluorophosphate. The presently preferred anion is chloride.

The nitrogen-containing compound can contain as many derivatives as different types of substituents. It is presently preferred that a partially alkylated or a fully alkylated imidazolium halide such as chloride be used. A fully alkylated imidazolium halide is one in which all hydrogen on the imidazolium ring is replaced with a hydrocarbyl radical that can contain 1 to about 20 carbon atoms and can be an alkyl, alkenyl, or aryl radical. Generally, the ammonium and phosphonium salts are peralkylated, the pyridinium salt is N-substituted, and imidazolium salt is N,N-disubstituted.

Examples of suitable nitrogen-containing compound include, but are not limited to, 1-ethyl-3-methyl-1H-imidazolium, 1-propyl-3-methyl-1H-imidazolium, 1-butyl-2,3-dimethyl- 1H-imidazolium, 1-butyl-2,3,4,5-tetramethylimidzaolium, 1,2,3,4,5-pentamethylimidazolium, 1-methylpyridinium, a derivative of pyridine having alkyl groups in non-nitrogen positions on the ring, tetraethylammonium, tetramethylphosphonium, and combinations of two or more thereof. The presently preferred imidazolium halide is 1-ethyl-3-methyl-1H-imidazolium chloride, 1-butyl-2,3,4,5-tetramethyl-1H-imidazolium chloride, or 1,2,3,4,5-pentamethyl-1H-imidazolium chloride.

An imidazolium halide can also be combined with a Group IB metal halide, a Group IIIA metal halide, a group VIII metal halide, or combinations of two or more thereof. The term "Group IB", "Group IIIA", "Group VB", or "Group VIII" used in the invention refers to the CAS version of the Periodic Table of the Elements, CRC Handbook of Chemistry & Physics, 67th edition, 1986–1987, CRC Press, Boca Raton, Fla. Examples of suitable Group IB halides include copper halide such as copper chloride and copper bromide; silver halide such as silver chloride; and gold halide such gold chloride, and combinations of two more thereof. Examples of Group IIIA halides include aluminum halide such as aluminum chloride and aluminum bromide; boron halide such as boron chloride; gallium halide such as gallium chloride; indium halide such as indium chloride; thallium halide such as thallium chloride; or combinations of two or more thereof. Examples of suitable Group VB halides include tantalum halide such as tantalum chloride; vanadium halide such as vanadium chloride; niobium halide such as niobium chloride; or combinations of two or more thereof. Examples of Group VIII halides include one or more of iron halides such iron chlorides and iron bromides; cobalt halides such as cobalt chloride and cobalt bromide; and nickel halide such as nickel chloride and nickel bromide; rhodium halide such as rhodium chloride; and rhenium halide such as rhodium chloride.

The co-electrolyte can be present in any quantity so long as the quantity can reduce the melting temperature of an alkali metal halide to the low temperature disclosed above. Generally, the molar ratio of the co-electrolyte to the alkali metal halide can be in the range of from about 0.01:1 to about 100:1, preferably about 0.1:1 to about 10:1, and most preferably about 0.5:1 to about 2:1. If a second metal (Group IB, IIIA, or VIII) halide is present with an imidazolium salt, the molar ratio of the second metal halide to the alkali metal halide can be in the same range. For example, an electrolyte comprising 1-ethyl-3-methyl-1H-imidazolium chloride, aluminum chloride, and sodium chloride can have a molar ratio of 1-ethyl-3-methyl-1H-imidazolium chloride to aluminum chloride to sodium chloride about 1:2:1.

The anode of an electrolysis cell can consist of electrically conductive carbon, an DSA® (dimensionally stable anode), a Group VIII metal oxide, or a Group VIII metal such as platinum, which is not corroded by the anodically liberated halide such as, for example, chlorine gas. On the cathode side of the cell the cathode itself can consist of electrically conductive carbon or a metal such as a Group VIII metal in contact with a polymeric ion exchange membrane. The cathode can be provided with physical means for transporting cathodically produced liquid alkali metal to an external, heated collection chamber. During operation of the cell, the liquid alkali metal produced can share in the cathode function with the cathode. Physical means for transporting liquid alkali metal away from the cathode can be machined channels or grooves, a system of holes, or use of porous materials having interconnected pores permitting molten alkali metal to flow into the collection vessel. There are numerous other ways of performing this function which one skilled in the art can devise depending on one's preference.

Wishing not to be bound by theory, use of a polymeric ion exchange membrane can prevent cathodically induced chemical degradation of the imidazolium-based electrolyte during operation. The ion exchange membrane can be a material that lets alkali metal ions pass easily through the membrane but will not let significant amounts of higher-valent cations pass. Examples of suitable membrane materials include, but are not limited to, perfluorinated ion-exchange polymers available under the trade name Nafion®, available from E.I. duPont de Nemours & Company, Wilmington, Del. In order to protect the Nafion® membrane from degradation caused by reaction with metallic alkali metal formed on the surface of the cathode, a second membrane can be used. The second membrane can be interspersed between the first membrane and the cathode. Examples of suitable second membranes include acrylic polymers. Other materials are also suitable. It is preferred to have the Nafion® membrane, the acrylic membrane and the cathode in intimate physical contact with each other. This can be accomplished in a number of ways. For example, it can be done by painting a solution of the acrylic polymer onto a carbon cathode followed by applying a solution of the Nafion® polymer and drying the coated cathode/membrane assembly.

According to the invention, moisture is preferably excluded because water can react with, and hydrolyze, a halide in the electrolyte. This can be achieved by constructing the cell in a gas-tight, hermetically sealed fashion. In order to achieve a high degree of space efficiency it is advantageous to construct the cell in the well-known stacked-multiple-flat-plate arrangement. Known electrochemical engineering practices are used in providing means for circulating and replenishing the electrolyte, for providing electrolysis current, for handling cathode product liquid alkali metal and anode product chlorine gas. The cell is generally operated in a continuous mode. Because of its low temperature operation the invention process is well suited for automated operation.

Because a fully alkylated imidazolium chloride is resistant to cathodic reduction, a porous diaphragm instead of a membrane can be used when it is present in the electrolyte thereby reducing the operating cost. The diaphragm can consist of a variety of different materials. Illustrative examples are glass-fiber fabric and polymeric screens and fabrics. Cell design and construction are similar to those disclosed above.

According to the invention, the co-electrolyte can also be a Group IIIA halide, a Group VB halide, or combinations thereof For example, a near-eutectic inorganic salt mixture of a group IIIA halide and an alkali metal halide or mixtures of a Group IIIA halide, a Group VB halide, and an alkali metal halide. The molar ratio of a Group IIIA halide or a Group VB halide to an alkali metal halide can be in the range of from about 0.01:1 to about 100:1, preferably about 0.1:1 to about 10:1, and most preferably about 0.5:1 to about 2:1. For example, a mixture comprising $NaCl/AlCl_3/TaCl_5$ (molar ratio of about 20:70:10) can be used. These mixtures can also be used with an ion exchange membrane similar to that described above. Operating temperature of an electrolysis cell using one of these mixtures can be in the range of about 130° C. to 160° C.

According to the invention, an electrolysis can also be carried out using an aqueous solution of an alkali metal halide, i.e., water can be a co-electrolyte. The weight percent (%) of an alkali metal halide can be in the range of from about 1 to about 40% , preferably about 10 to about 35% , more preferably about 20 to about 35% and most preferably about 30%. For example, a solution containing about 30% NaCl and 70% $H_2O$ can be used with or without a porous diaphragm.

When water is used as co-electrolyte, the cathode can consist of a metal cathode that is a metal alloy having a melting point below the boiling temperature of the aqueous solution at the internal operating pressure used in the operation of the cell. If the cell is operated at ambient atmospheric pressure, the metal cathode alloy can have a melting temperature below about 105° C. A suitable metal cathode can also include a high hydrogen overvoltage to favor alkali metal deposition at the cathode over hydrogen evolution; a degree of solubility of metallic alkali metal in the metal cathode alloy; and a sufficiently high boiling temperature of the liquid metal cathode alloy. The boiling temperature of the alloy is generally substantially above the boiling temperature of an alkali metal to permit post-electrolysis separation of alkali metal from the liquid metal cathode alloy via various distillation methods. According to the invention, it is preferred that the alloy has (1) a melting temperature below about 105° C., (2) a high hydrogen overvoltage (in the same order as mercury), (3) a solubility for an alkali metal, and (4) a boiling temperature substantially above that of the alkali metal. Examples of suitable liquid metal cathode alloys can be an alloy derived from two or more metals selected from the group consisting of bismuth (Bi), lead (Pb), tin (Sn), antimony (Sb), cadmium (Cd), gallium (Ga), thallium (Tl), and indium (In). Cell design, construction and operation can be substantially the same as that disclosed above. An advantage of using a metal alloy in the cathode is that, because of the higher density of the liquid metal cathode alloy compared to that of the electrolyte, a horizontal cell design can be used, analogous to that of the mercury cells for caustic/chlorine production. Separation of alkali metal from the alkali metal-containing liquid cathode alloy can be done in an operation outside the electrolytic cell thereby facilitating the electrolysis process. For example, various distillation methods can be used, such as ambient pressure distillation, vacuum distillation and/or inert carrier gas distillation using nitrogen or other inert gas species as the carrier gas. Because of its much lower boiling temperature (much higher vapor pressure), alkali metal vaporizes out of the liquid alloy and can be subsequently condensed and collected in a receiver vessel. The "denuded" liquid metal cathode alloy can be recycled to the cathode compartment of the cell. Countercurrent heat exchanger techniques can be used to minimize the energy requirements of the separation or purification step, or both steps. Other methods of alkali metal separation, such as solvent extraction, are also feasible.

In another embodiment of the invention, an alkali metal electrolysis process using a liquid "solvated alkali metal" cathode is provided. The cathode can be used in conjunction with an ion-exchange membrane or a porous diaphragm. The electrolyte can be the same as that disclosed above in the first embodiment. A liquid "solvated alkali metal" cathode can have the advantage that the cell operating temperature can be well below the melting temperature of alkali metal (98° C.).

The term "solvated alkali metal" used herein refers to an alkali metal and one or more organic solvents such as, for example, ethers and aromatic compounds. An example of a solvated alkali metal is sodium/naphthalene/ethylene glycol dimethylether having a weight ratio of about 25:150:50. There are a number of other suitable solvent systems for alkali metal. The alkali metal content in the solvated alkali metal can be any weight % as long as that content can make the solvated alkali metal solution electrically conductive. Generally, the alkali metal content can be about 5 to about 80, preferably about 20 to about 70 and most preferably about 15 to about 60% by weight. After electrolysis a part of the alkali metal-enriched solvated alkali metal solution can be transferred to a separate vessel in which the solvent can be removed from the alkali metal by, for example, distillation. Pure alkali metal can be transferred to alkali metal storage and shipping by conventional means. The "denuded" solvent can be recycled into the liquid solvated alkali metal-cathode stream in the electrolysis circuit.

The following example is provided to further illustrate the invention and are not to be construed to unduly limit the scope of the invention.

In the example, a procedure for the preparation of sodium metal in an imidazolium chloride-aluminum chloride-sodium chloride molten salt bath is disclosed. A membrane-covered cathode is used for the selective reduction of sodium ions.

All chemicals were used as received. 1-Ethyl-3-methyl-H imidazolium chloride, aluminum chloride (99.99%), naphthalene (99+%), polyacrylic acid (25 wt % solution in water), and Nafion® perfluorinate ion-exchange resin (5 wt % solution in a mixture of lower aliphatic alcohols and water) were purchased from Aldrich (Milwaukee, Wis. 53201 USA). Sodium chloride, sodium hydroxide, potassium hydroxide, and tetrahydrofuran (TX-02484-6) were from EM Science (Gibbstown, N.J. 08027 USA). Tetrahydrofuran (THF) was deaerated with nitrogen and stored over activated 4A molecular sieves prior to use. Stainless steel 304 coupons with a diameter of 1.2 cm were obtained from Metal Samples Co., Inc. (Munford, Ala. 36268 USA).

Electrical Equipment. A CV-27 potentiostat from Bioanalytical Systems (West Lafayette, Ind. 47906-1382 USA) was used. A C-200 H-type cell from the Electrosynthesis Co., Inc. (E. Amherst, N.Y. 08540) was used to hold electrodes and molten salt bath. A flat sample holder from EG&-G Princeton Applied Research (Princeton, N.J. 08540) was used as a cathode. A 10-$cm^2$ platinum flag electrode from the Electrosynthesis Co., Inc. was used as an anode; the same electrode without the 10-$cm^2$ platinum foil was used as a pseudoreference electrode.

Preparation of Membrane. A 1.2×1.2 cm piece of carbon felt (GF-S2 from Electrosynthesis Co., Inc.) was treated with two applications of polyacrylic acid solution, which had been converted to the sodium form by addition of 10 ml of 1 N NaOH and 0.5 g ground NaOH to 10 ml of polyacrylic acid solution. The carbon felt was air-dried between the applications and then air-dried overnight. One surface of the resulting derivatized carbon felt was painted with Nafion® solution, which was converted to the sodium form by addition of 0.02 g NaOH to 2 ml of the Nafion® resin described above. The carbon felt was air-dried and then heated at 160° C. for one minute. The membrane was then cut to the size of the SS304 coupon and dried under vacuum overnight.

Preparation of Molten Salt. All manipulations were conducted in a Vacuum Atmosphere dry box under nitrogen gas. The molten salt bath containing 1-ethyl-3-methyl-1H-imidazolium chloride, aluminum chloride, and sodium chloride in a 1:2:1 molar ratio was prepared according to the literature procedure disclosed in Journal of the Electrochemical Society, 143, 2262–2266 (1996). The imidazolium salt and aluminum chloride were mixed first to generate an acidic bath, which was then neutralized by addition of sodium chloride. The ternary bath was allowed to mix overnight (about 16 hours) prior to use.

Electrolysis was conducted in a Vacuum Atmosphere dry box under nitrogen gas. The H-type cell was placed in a heating mantle and buried in sand to a depth of about 2.5 inches (6.35 cm). The sand bath temperature was maintainedat 100–120° C. throughout the electrolysis. The molten salt was added to the cell so that when the flat cell holder was placed in the cell, the frits connecting the chambers of the cell were covered with molten salt. Solid sodium chloride was added to the bath prior to the start of electrolysis to maintain the 1:2:1 molar ratio of imidazolium salt: aluminum chloride: sodium chloride in the molten salt bath.

The cathode was assembled in the flat cell holder in the following manner. A Teflon® washer was placed in the Tefzel®-280 specimen holder. The membrane was added next, with the Nafion®-coated side facing out of the holder. A SS304 coupon was placed in the holder next. The sample holder plug and sample holder cap with O-ring were put in place. Attachment of the electrode mounting rod and working electrode holder allowed the assembly to be added to the C-200 H-type cell. A 1-$cm^2$ surface of the coated carbon felt was in contact with the electrolyte.

The platinum flag electrode was suspended in the electrolyte. This chamber was flushed with nitrogen into a methanolic KOH solution to scrub chlorine generated during the sodium deposition reaction.

Potentials (relative to the platinum wire electrode) of −1.95V to −2.15V were applied for a total of 15 hours over two days. Applied potential, current, and bath temperature are shown in Table 1. After the first 10 hours, the applied potential was discontinued and the bath temperature was reduced to 96° C. On restart of the electrolysis, the current slowly climbed.

Sodium formation was demonstrated in the following manner. After the 15 hours of electrolysis, the membrane was removed from the flat cell holder and washed briefly with THF to remove the molten salt. The carbon felt and SS304 coupon, which were cemented together, were placed in approximately 5 ml of 0.1M naphthalene solution in THF. A green color, indicating sodium naphthalide, was not observed. Approximately 5 ml of water, following the removal of the membrane, was added. A vigorous evolution of gas was observed suggesting that the sodium was formed inside the membrane. Naphthalene cannot penetrate the membrane, but water is easily transported through both layers. Sodium reacts vigorously with water to produce sodium hydroxide and hydrogen gas (F. A. Cotton and G. Wilkinson, "Advanced Inorganic Chemistry,"4th Edition, John Wiley and Sons: New York, 1980; pp. 257–258).

TABLE 1

| Time (hour) | Temperature (° C.) | Applied Potential (V) | Current (mA) |
|---|---|---|---|
| 0.00 | 89 | −2.00 | −0.234 |
| 0.25 | 91 | −2.00 | −0.297 |
| 0.58 | 96 | −2.00 | −0.427 |
| 0.83 | 100 | −2.00 | −0.600 |
| 1.17 | 103 | −2.00 | −0.913 |
| 1.42 | 103 | −2.00 | −1.151 |
| 1.67 | 103 | −2.00 | −1.270 |
| 2.08 | 103 | −2.00 | −1.470 |
| | | −1.95[a] | −0.88 |
| 2.42 | 106 | −1.95 | −1.06 |
| 4.08 | 110 | −1.95 | −1.37 |
| 5.67 | 112 | −1.95 | −1.39 |
| 6.00 | 112 | −2.00 | −2.30 |
| | | −2.00[b] | |
| 6.83 | 112 | −2.00 | −1.70 |
| | | −2.10[b] | −3.57 |
| 7.08 | 112 | −2.10 | −5.14 |
| | | −2.15[b] | |
| 8.41 | 112 | −2.15 | −7.27 |
| 8.58 | 112 | −2.15 | −7.32 |
| 10.08 | 112 | −2.15[c] | −7.37 |
| 10.38 | 104 | −2.15 | −0.645 |
| 10.96 | 105 | −2.15 | −0.780 |
| 11.13 | 106 | −2.15 | −1.210 |
| 11.71 | 108 | −2.15 | −1.910 |
| 11.88 | 105 | −2.10[d] | −1.410 |
| 12.21 | 106 | −2.10 | −1.510 |
| 12.88 | 106 | −2.10 | −1.610 |
| | | −2.15[b] | −2.41 |
| 13.80 | 105 | −2.15 | −2.55 |
| 14.22 | 106 | −2.15 | −3.30 |
| 15.22 | 98 | −2.15 | −3.71 |

[a]Applied potential reduced
[b]Applied potential increased
[c]Potential discontinued; bath cooled to 96° C.
[d]Applied potential decreased to −2.10 V

What is claimed is:

1. A process for producing an alkali metal comprising electrolyzing an alkali metal halide in the presence of a co-electrolyte selected from the group consisting of (1) a nitrogen-containing compound and optionally one or more Group IB halides, Group IIIa halides, Group VIII halides wherein said nitrogen-containing compound comprises an organic cation; (2) a Group IIIA halide, a Group VB halide, or combinations of a Group IIIA halide and a Group VB halide; and (3) water.

2. A process according to claim 1 wherein said process is carried out at a temperature below 300° C.

3. A process according to claim 1 or 2 wherein said nitrogen-containing compound is one or more compounds selected from the group consisting of imidazolium salts, N-alkylpyridinium salts, tetraalkylammonium salts, and tetraalkylphosphonium salts.

4. A process according to claim 1 or 2 wherein said nitrogen-containing compound is one or more compounds selected from the group consisting of 1-ethyl-3-methyl-1H-imidazolium, 1-propyl-3-methyl-1H-imidazolium, 1-butyl-2,3-dimethyl-1H-imidazolium, 1-butyl-2,3,4,5-tetramethylimidzaolium, 1,2,3,4,5-pentamethylimidazolium, 1-methylpyridinium, a derivative of pyridine having alkyl groups in non-nitrogen positions on the ring, tetramethylammonium, tetramethylphosphonium; said Group IB halide is copper halide, silver halide, or gold halide; said Group IIIA halide is aluminum halide, boron halide, gallium halide, indium halide, or thallium halide; and said Group VIII halide is iron halide, cobalt halide, or nickel halide.

5. A process according to claim 4 wherein said imidazolium halide is 1-ethyl-3-methyl-1H-imidazolium chloride and said Group IIIA halide is aluminum chloride.

6. A process according to claim 1 or 2 wherein said co-electrolyte comprises aluminum chloride and 1-ethyl-3-methyl-1H- imidazolium chloride and said process is carried out in an electrolysis cell containing an ion exchange membrane.

7. A process according to claim 1 or 2 wherein said co-electrolyte comprises aluminum chloride and a fully alkylated imidazolium chloride and said process is carried out in an electrolysis cell containing an ion exchange membrane or a diaphragm.

8. A process according to claim 1 or 2 wherein said co-electrolyte comprises aluminum chloride and tantalum chloride and said process is carried out in an electrolysis cell containing an ion exchange membrane.

9. A process according to claim 1 or 2 wherein said co-electrolyte is water.

10. A process according to claim 9 wherein said process is carried out in an electrolysis cell whose cathode consists of a liquid, low melting alloy of two or more metals selected from the group consisting of Bi, Pb, Sn, Sb, In, Ga, Tl, and Cd to produce an alkali metal.

11. A process according to claim 10 and wherein the alkali metal is separated from said alloy by distillation.

12. A process according to claim 3 wherein said nitrogen compound is one or more compounds selected from the group consisting of 1-ethyl-3-methyl-1H-imidazolium, 1-propyl-3-methyl-1H-imidazolium, 1-butyl-2,3-dimethyl-1H-imidazolium, 1-butyl-2,3,4,5-tetramethylimidzaolium, 1,2,3,4,5-pentamethylimidazolium, 1-methylpyridinium, a derivative of pyridine having alkyl groups in non-nitrogen positions on the ring, tetramethylammonium, tetramethylphosphonium; said Group IB halide is copper halide, silver halide, or gold halide; said Group IIIA halide is aluminum halide, boron halide, gallium halide, indium halide, or thallium halide; and said Group VIII halide is iron halide, cobalt halide, or nickel halide.

13. A process according to claim 3 wherein said co-electrolyte comprises aluminum chloride and 1-ethyl-3-methyl-1H- imidazolium chloride and said process is carried out in an electrolysis cell containing an ion exchange membrane.

14. A process according to claim 5 wherein said co-electrolyte comprises aluminum chloride and 1-ethyl-3-methyl-1H-imidazolium chloride and said process is carried out in an electrolysis cell containing an ion exchange membrane.

15. An electrolyte composition comprising an alkali metal halide and a co-electrolyte wherein said co-electrolyte comprises a nitrogen-containing compound and optionally one or more Group IB halides, Group IIIA halides, or Group VIII halides; said nitrogen-containing compound is one or more compound selected from the group consisting of 1-ethyl-3methyl-1H-imidazolium, 1-propyl-3-methyl-1H-imidazolium, 1-butyl-2,3-dimethyl-1H-imidazolium, 1-butyl-2,3,4,5-tetramethylimidzaolium, 1,2,3,4,5-pentamethylimidazolium, 1-methylpyridinlum, a derivative of pyridine having alkyl groups in non-nitrogen positions on the ring, tetramethylammonium, tetramethylphosphonium, said Group IB halide is copper halide, silver halide, or gold halide; said Group IIIA halide is aluminum halide, boron halide, gallium halide, indium halide, or thallium halide; and said Group VIII halide is iron halide, cobalt halide, or nickel halide.

16. A composition according to claim 15 wherein said co-electrolyte is 1-ethyl-3-methyl-1H-imidazolium chloride and aluminum chloride.

17. A composition according to claim 15 wherein said co-electrolyte comprises aluminum chloride and 1-ethyl-3-methyl-1H-imidazolium chloride.

18. A composition according to claim 15 wherein said co-electrolyte comprises aluminum chloride and a fully alkylated imidazolium chloride.

* * * * *